US005174447A

United States Patent [19]

Fleming

[11] Patent Number: 5,174,447

[45] Date of Patent: Dec. 29, 1992

[54] IMPLEMENT RETAINER

[76] Inventor: Bruce Fleming, P.O. Box 154, River Pines, Calif. 95675

[21] Appl. No.: 400,800

[22] Filed: Aug. 30, 1989

[51] Int. Cl.[5] ..... B65D 85/20; B65D 30/22

[52] U.S. Cl. ..... 206/373; 206/806; 383/39; 220/23.83; 220/500

[58] Field of Search ..... 206/349, 372, 373, 376, 206/377, 806; 383/39, 40; 220/23.83, 23.86, 85 R, 85 D, 85 H, 500

[56] References Cited

U.S. PATENT DOCUMENTS

| | | | |
|---|---|---|---|
| 1,094,009 | 4/1914 | Parkhurst | 206/373 |
| 1,220,793 | 3/1917 | Spector | 383/40 X |
| 1,286,597 | 12/1918 | Jennings | 206/349 |
| 1,514,885 | 11/1924 | Bigler | 206/373 |
| 1,679,101 | 7/1928 | Sternthal | 206/372 |
| 2,316,328 | 4/1943 | Guenther et al. | 383/40 X |
| 2,533,355 | 12/1950 | Comfort | 220/85 D |
| 2,702,640 | 2/1955 | Leonard | 220/85 D |
| 2,758,798 | 8/1956 | Schmidt | 206/349 |
| 2,778,398 | 1/1957 | Edwards | 220/85 R |
| 2,979,098 | 4/1961 | Greaves | 383/40 |
| 3,435,868 | 4/1969 | Stermer | 383/39 |
| 4,475,660 | 10/1984 | Cain | 220/23.86 |
| 4,765,472 | 8/1988 | Dent | 206/373 |
| 4,773,535 | 9/1988 | Cook | 206/373 |
| 4,826,007 | 5/1989 | Skeie | 206/373 |
| 4,993,551 | 2/1991 | Lindsay | 220/500 X |

*Primary Examiner*—Paul T. Sewell
*Assistant Examiner*—Jacob K. Ackun, Jr.
*Attorney, Agent, or Firm*—Bernhard Kreten

[57] ABSTRACT

A tool carrier for use with open top containers formed initially as a rectangular blank having side edges sewn together to form a cylinder. The cylinder is inserted within the open top area of the container and oriented to be draped on both interior and exterior side walls of the container. Thus, the tool carrier forms inner and outer sheaths upon which a plurality of tools can be carried. The tools are carried on the inner and outer sheaths by means of pockets and loops through which the tools or a portion thereof are to pass.

15 Claims, 2 Drawing Sheets

IMPLEMENT RETAINER

FIELD OF THE INVENTION

The following invention relates generally to a means for increasing the useful payload capability of containers which are used to carry tools or material. In addition, the invention relates to a means for organizing the tools or the material carried within the container.

BACKGROUND OF THE INVENTION

Tradesmen frequently use empty buckets within which they transport their tools on job sites. Most commonly, these tool buckets merely have the needed tools randomly placed within the bucket. As can be imagined, considerable time can be wasted in finding tools or other articles, particularly smaller ones which have gravitated towards the bottom of the bucket.

Some skilled workers will carry a plurality of tools on a belt supported by the worker, and this belt supports a pouch having a plurality of partitions within which tools are supported. While this solution to the problem provides ready access and an orderly orientation of tools, it is clear that the worker must continually support all tools whether they are to be used or not, and the tool pouch provides an area which can be snagged, posing a danger to the worker. The patent to Viio, U.S. Pat. No. 4,523,702 exemplifies one such tool holder. It is to be noted that this tool holder shares the difficulties discussed immediately supra.

SUMMARY OF THE INVENTION

The instant invention is distinguished over the known prior art in a plurality of ways. One such difference embraces the means by which the instant invention organizes tools to be carried within an open top receptacle. Typically, a receptacle such as a used paint container will have a round bottom wall, a sidewall extending upwardly from the bottom wall having a peripheral upper lip and may have a means for supporting a handle thereon.

The instant invention is configured initially as a tubular sleeve having an inner surface and an outer surface. The inner sleeve surface is configured to rest against the upwardly extending sidewalls of the container, both interior and exterior sidewall surfaces thereof. The outer surface of the sleeve will thus be draped over the container in such a manner that it forms an inner sheath and an outer sheath which is draped on and depends from the lip of the container. A mid-portion of the sleeve is supported on and by the lip of the container and the inner and outer sheaths depend therefrom. Both the inner and outer sheaths support a plurality of tool retaining means which may be configured as loops, pockets, handle holes, snaps, flaps, etc., constructed so that articles of diverse shape can be neatly organized thereon.

While the preferred embodiment will discuss an open top container in the shape of a bucket including a bottom wall, an upwardly extending sidewall connected to the bottom wall at a peripheral edge thereof, the sidewall having an interior and exterior surface, the sidewall terminating in a top lip and supporting a handle from a top opening, various other configurations of containers having an open top are within the scope of the invention. Thus, although this invention has particular utility when used with so called five-gallon buckets, smaller or larger containers can also be used, such as coffee cups or desk organizers which conventionally hold pens and other writing implements. Moreover, the container which is supporting the invention can be of any geometrical configuration, and is not limited to a substantially cylindrical container. The invention may also be integrally formed with the container.

OBJECTS OF THE INVENTION

Accordingly, it is a primary object of the present invention to provide a novel and useful tool carrier.

A further object of this invention is to provide a device as characterized above, which is relatively inexpensive to make, lends itself to mass production techniques and is extremely durable and efficient in use.

It is yet a further object of the present invention to provide a device as characterized above which is configured to be used with a conventional open top bucket and is formed from a blank of flexible material oriented as a sleeve having an inner surface and an outer surface, a plurality of tool retaining means carried on upper and lower portions of the outer surface, whereby, when the carrier is draped on the bucket, along a top lip thereof, with a mid-portion of the sleeve supported on the lip, the tool retaining carrier is suspended on both the interior and exterior sidewalls of the bucket, allowing tools or other articles to be carried both interiorly of the bucket and exteriorly.

Viewed from a second vantage point, it is an object of the present invention to provide a tool carrier which includes a container having a bottom wall and a sidewall upwardly extending from the periphery of the bottom wall, thereby defining an open top container within which tools are to be carried, and a means on both an inner sidewall and an outer sidewall surface to support tools thereon.

Viewed from yet a third vantage point, it is an object of the present invention to provide a method for carrying a plurality of diversely shaped tools in a bucket, such that the tools are easily accessible and stored in an organized manner, the steps including: lining a wall of the bucket with a sheath of material, forming a plurality of tool engaging holders on the sheath and orienting the holders to be exposed to receive tools thereon, whereby, tools carried thereon are organized and accessible.

A further object contemplates forming a carrier from flexible material, wherein, one surface of the flexible material is configured with a plurality of pockets thereon, and initially the material is configured as a substantially planar blank. Once the plural pockets or tool retaining means are disposed on one surface, opposed side edges of the blank are united to form a sleeve. Thereafter, the sleeve is oriented such that the outer surface containing the pockets and other tool retaining loops etc., are draped on a rigid container so that the loops are disposed both on an inner and outer surface of the container for transport.

These and other objects will be made manifest when considering the following detailed specification when taken in conjunction with the appended drawing figures.

BRIEF DESCRIPTION OF THE DRAWING FIGURES

Figure 4:
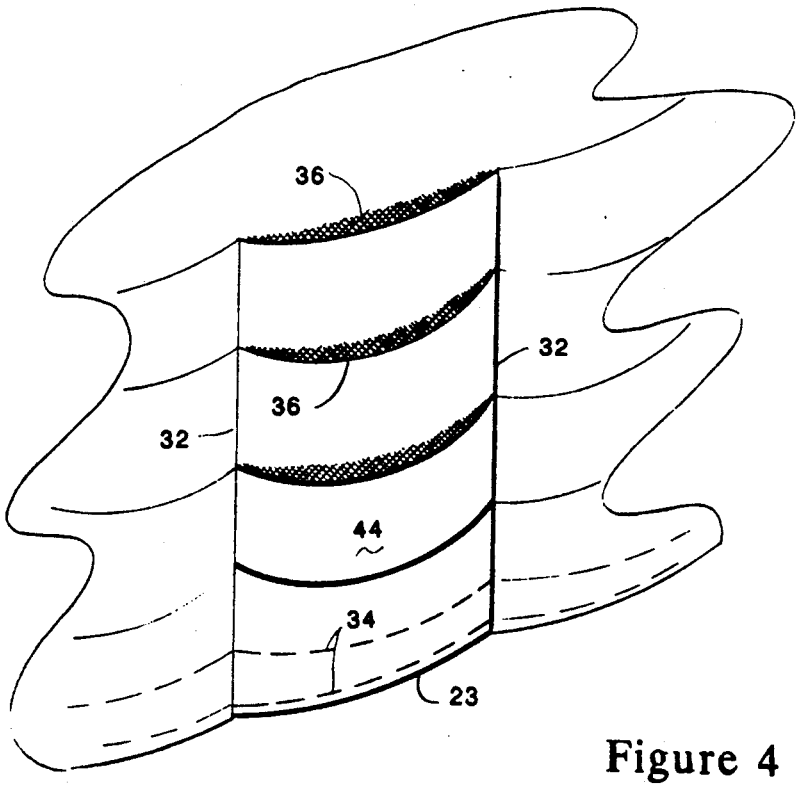

FIG. 4 reflects a pocket detail in perspective.

BRIEF DESCRIPTION OF THE PREFERRED EMBODIMENT

Referring to the drawings now, wherein like reference numerals refer to like parts throughout the various drawing figures, reference numeral 10 is directed to the tool carrier according to the present invention.

In its essence, the tool carrier 10 is formed from flexible material so as to readily conform to the shape of the container within which it is to be carried and supported. Thus, flexible material having wear-resistant properties such as canvas, vinyl, leather or other types of cloth made from synthetic or natural materials would all appear to be suitable for utilization in the instant invention.

Figure 1:
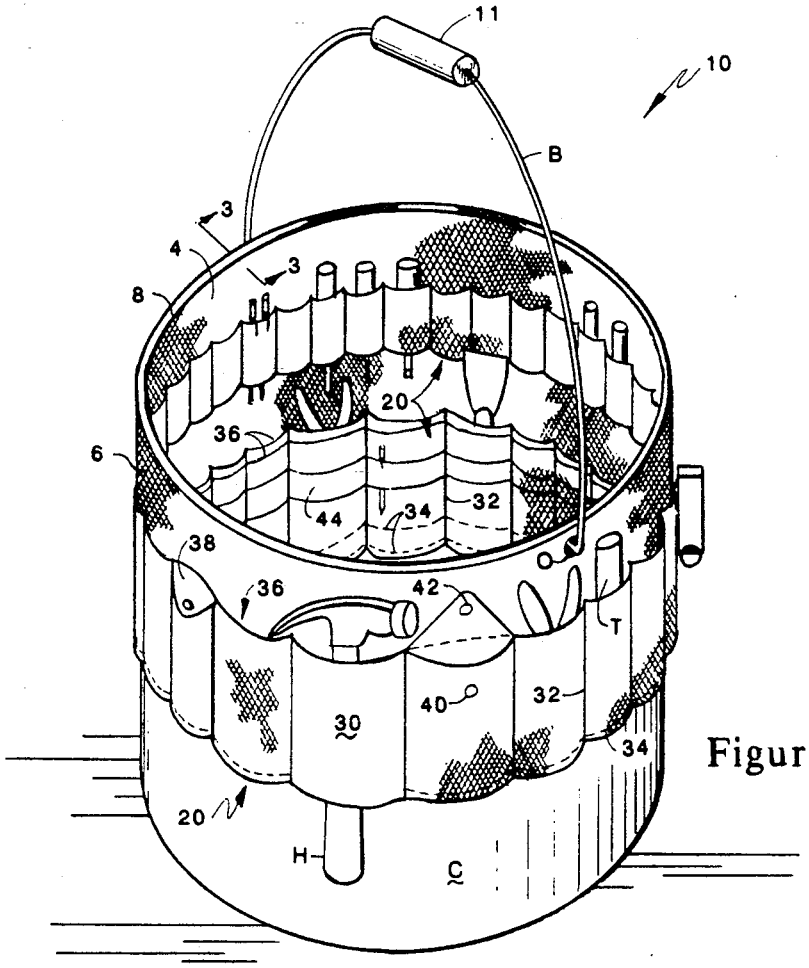
FIG. 1 is a perspective view of the apparatus according to the present invention installed on a container.

In its essence, the tool carrier 10 is best used with an open top container C such as a bucket as depicted in FIG. 1. The bucket includes a bottom which in this figure is depicted as being substantially circular, and an upwardly extending peripheral wall which is connected to a peripheral border or edge of the bottom wall. Thus, the sidewall is substantially cylindrically shaped. The sidewall has a top lip and no top wall is provided, thereby defining an open top container. The bucket includes a handle H and a supporting wire bail B connected to the sidewall through openings O. Thus, the tool carrier 10 should be suitably configured to conform to this ideal container.

Figure 2:
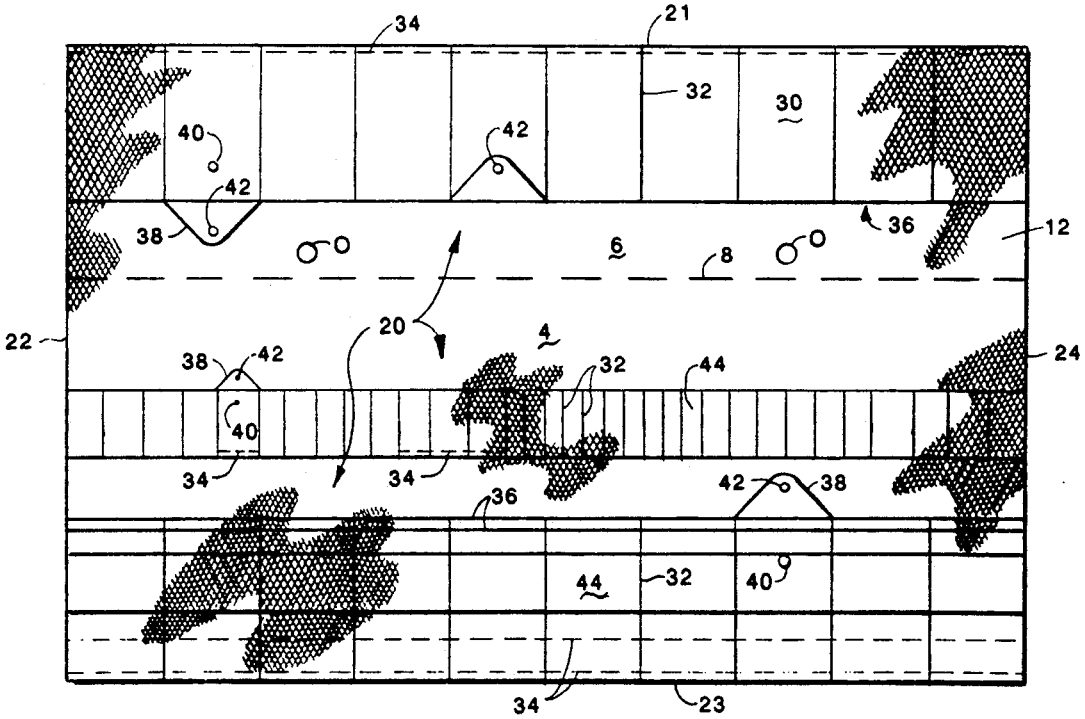
FIG. 2 is a plan view of that which is shown in FIG. 1 with the container removed and the tool carrier in a flattened condition, embodied as a blank prior to sewing together side edges.
Figure 3:
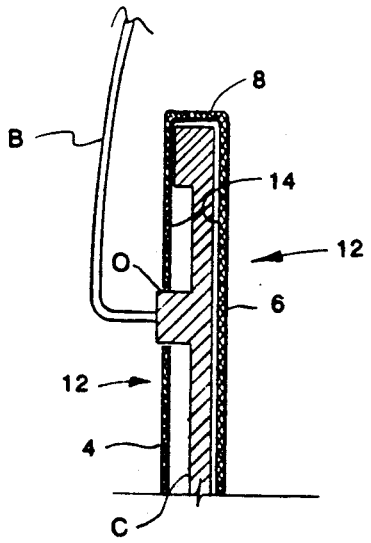
FIG. 3 is a sectional view taken along lines 3—3 of FIG. 1.

The carrier 10 is initially formed as a rectangular blank as shown in FIG. 2. To achieve the FIG. 1 configuration, marginal side edges 22,24 are joined to form a tubular sleeve. When formed as shown in FIGS. 1 and 3, it includes an exposed outer sidewall surface 12 which faces outwardly with respect to the bucket, and an inner surface 14 which rests directly against the interior and exterior sidewalls of the bucket.

In addition, the blank has a mid-portion 8 which corresponds to an area where the carrier 10 is placed adjacent the top lip of the bucket. Thus, when the lip and the mid-portion 8 are in tangential registry by placing the inner surface 14 on a top edge of the lip, the tool carrier 10 is draped such that an outer sheath 6 lies on an outer surface defining the exterior sidewall of the bucket, and an inner sheath 4 rests against an interior sidewall of the bucket.

As shown in FIG. 2, the outer sheath 6 corresponds to the upper portion of the blank. Similarly, the inner sheath 4 corresponds to the lower portion of the blank. In order to conform the blank of FIG. 2 into the configuration of a sleeve shown in FIGS. 1 and 3, opposed side edges 22, 24 are united by a zipper, buttons, snaps or sewing. Thus, the rectangular blank is transformed into a substantially cylindrical configuration. For deployment on the bucket, the lower portion 4 of the blank is placed within the bucket and thereby defines the inner sheath 4 of the tool carrier 10. The upper portion 6 of the blank is pulled down over the outer wall of the bucket, thereby becoming the outer sheath 6 of the carrier, such that the inner and outer sheaths 4,6 depend from the bucket by being suspended from the mid-portion 8 as it lies upon the top lip of the bucket.

Because this invention was originally contemplated as being used in conjunction with a five-gallon bucket commonly found on job or construction sites, all of which have handles H supported on the bucket by means of a wire bail B passing through openings O on the bucket upper wall, the tool carrier 10 includes a pair of openings O corresponding to the openings which support the wire bail B. Thus, for initial installation of the device, the wire bail B and it's handle H must be removed in order to allow the sleeve to be deployed on the bucket, forming the carrier 10.

As shown in FIGS. 1 and 2, a plurality of tool retaining means 20 are supported on the tool carrier 10. Thus, as shown, some of the tools depicted are carried by loops which are configured to gird handles of tools, or pockets which would be blind bores, allowing the tool to be slid within the pocket and supported therein. In addition, however the pockets may also be provided with flaps so that the tools contained therewithin are secured and these flaps may be fixed shut on the pockets by means of snaps as should be evident.

More specifically, the outer sheath 6 shows a plurality of loops 30 running the length of the blank, so that these loops 30 circumscribe the entire container C. These loops 30 are formed by stitching two layers of material together. As seen, stitching can preferably be oriented either parallel to the side edges 22,24 of the blank or parallel to the top and bottom edges 21, 23. The stitches 34 which parallel the top and bottom edges form bottom walls defining pockets, when taken in conjunction with the seams 32 which run parallel with the side edges 22,24. Thus, an opening 36 is provided for each pocket to receive a tool therein. Note that when considering the blank of FIG. 2, the pocket opens centrally, along the line 8 which defines the area of support on the lip of the bucket. FIG. 1 shows a tool T passing into a loop which has a closed bottom wall, by stitching 34 holding the tool T in place. Alternatively, absence of a bottom seam 34 will allow a tool such as a hammer H to pass through the holder forming a loop 30 through which the hammer can pass.

In addition, an open end 36 of the tool carrying compartment can be provided with a flap 38 which is shown in the figures in both open and closed position. To facilitate closing and to retain the flap 38 in a closed position, snaps 40,42 cooperate to retain the flap in a closed position.

In addition, FIGS. 1 and 2 reflect the use of a ribbon 44 circumscribing an inner periphery of the bucket, and configured as an elongate rectangular strip in FIG. 2. This ribbon 44 is provided with a plurality of seams 32 running parallel to the side edges 22, 24 to provide a plurality of loops through which tools pass. As might be imagined, seams 34 running parallel to the top and bottom edges 21, 23 will provide blind bores within which tools can be supported. In this case, however the orientation of the seams 34 are on an edge of the ribbon 44 remote from the line 8, and therefore is opposite from that which was described for the outer sheath 6. The inner sheath 4 has pockets oppositely sewn so that when draped as shown in FIG. 1, the bottom of the pockets are furthest from the rim of the container. A flap 38 is also illustrated in conjunction with this ribbon 44 having a snap connector 40,42 similar to that which was described for the outer sheath.

The bottom of FIG. 2 reflects a hybridization of that which has just been discussed with respect to the outer sheath pockets and some inner sheath pockets. As shown, a plurality of openings 36 can be provided on these tool retaining loops or pockets. The drawings illustrate two such pockets 36 having openings, oriented such that they are substantially superimposed one on top of the other to allow tools to be placed adjacent one and another, in overlying relationship. FIG. 4 reflects this detail. In addition, a loop formed from a ribbon 44 is superimposed on the two pockets. This allows a third tool to be superimposed on the thus described configuration. As shown, a pair of lower seams 34,34 running parallel to the top and bottom edges 21, 23 serve as bottom walls for the two pockets, and a seam 32 running parallel to the side edges 22,24 define the width of each pocket. As described above, a flap 38 may be used in conjunction with this combination of a series of pockets and loops utilizing a snap feature 40,42. Although two pockets and one loop were just illustrated, it should be apparent that these loops could be successively stacked.

Moreover, having thus described the invention, it should be apparent that numerous structural modifications and adaptations may be resorted to without departing from the scope and fair meaning of the instant application as defined here and above, and as claimed here and below.

I claim:

1. A tool carrier, comprising in combination:

a container having a bottom wall and a sidewall upwardly extending from a periphery of said bottom wall, said sidewall having an inner facing sidewall portion and an outer facing sidewall portion, said sidewall and bottom wall defining an open top container within which tools can be carried, said sidewall having means for supporting a bail thereon, said bail defining a supporting handle, and means on both said inner facing sidewall portion and outer facing sidewall portion to support tools thereon, wherein said tool support means includes a blank of flexible material configured initially as substantially rectangular in configuration having a pair of spaced parallel side edges and a top and bottom edge, a seam uniting said side edges thereby reconfiguring said blank as a substantially cylindrical sleeve having an interior and an exterior, a central portion on said exterior of said sleeve which is adapted to abut against the container at a top lip of said sidewall so that said sleeve is draped over the container reconfiguring said sleeve with an outer surface and an inner surface, said outer surface formed from said sleeve's interior and defining both an inner sheath and an outer sheath demarcated by said central portion which is draped on said lip of said container, said inner sheath covering said inner facing portion of said sidewall and said outer sheath covering said outer facing portion of said sidewall, a pair of hole-type openings passing through said outer sheath to provide clearance for the bail said hole-type openings being spaced from edges of said outer sheath by portions of said outer sheath and a plurality of said tool support means disposed on both said inner and outer sheaths.

2. The carrier of claim 1 wherein said tool support means includes a strip of material circumscribing said cylindrical sleeve of said sheath having stitching extending parallel to said side edges thereby providing a plurality of loops.

3. The carrier of claim 2 wherein said tool support means includes stitching running parallel to said top and bottom edges of said blank uniting one edge of said plurality of loops formed from said strip of material to said blank said stitching defining a bottom seam, thereby providing a pocket.

4. The carrier of claim 3 including a flap adapted to occlude an opening associated with a blind bore defined by one of said plurality of loops and said bottom seam.

5. The carrier of claim 4 wherein a plurality of further tool support means are tangentially superimposed on said pockets so that tools can be placed in tangential overlying registry, said further tool support means configured as loops.

6. A tool carrier configured to be used with a conventional open top bucket having sidewalls and a bottom wall, a top lip on the sidewalls and a bail fastened to the bucket just below the top lip, comprising, in combination:

flexible material oriented as a sleeve having an inner surface and an outer surface, said inner and outer surfaces having upper, lower and mid-portions, a plurality of tool retaining means carried on said upper and lower portions of said outer surface, said carrier is draped on the bucket along the top lip thereof by placing said inner surface mid-portion directly on the top lip so that said outer surface upper portion is within the container and said outer surface lower portion is outside the container, with said mid-portion of said sleeve supported on the lip, said tool retaining means are suspended on both the interior and exterior sidewalls of the bucket via said flexible material, wherein said tool support means includes a blank of flexible material configured initially as substantially rectangular in configuration having a pair of spaced parallel side edges and a top and bottom edge, a seam uniting said side edges thereby providing a substantially cylindrical sleeve having an interior and an exterior, a central portion on a surface of said sleeve which is adapted to abut against the container so that the sleeve is draped over the container defining a sleeve having an outer surface and an inner surface, the outer surface formed from an inner sheath and an outer sheath demarcated by the central portion which is draped on a lip of the container, hole-type openings on said outer sheath to allow the bail to pass therethrough to allow the bail to connect with said sidewall, said hole-type openings being spaced from edges of said outer sheath by portions of said outer sheath, and a plurality of said tool support means disposed on both said inner and outer sheaths.

7. The carrier of claim 6 wherein said tool support means includes a strip of material circumscribing said cylindrical sleeve of said sheath having stitching extending parallel of said side edges thereby providing a plurality of loops.

8. The device of claim 7 wherein said tool support means includes stitching running parallel to said top and bottom edges of said blank uniting one edge of said plurality of loops formed said strip of material to said blank said stitching defining a bottom seam, thereby providing a pocket.

9. The carrier of claim 8 including a flap adapted to occlude an opening associated with a blind bore defined by said plurality of loops and said bottom seam.

10. The carrier of claim 9 wherein a plurality of further tool support means are superimposed on said pockets so that tools can be placed in overlying registry.

11. A method for carrying a plurality of diversely shaped tools in a bucket having a handle such that the tools are easily accessible and stored in an organized manner, the steps including:

removing the handle from the bucket, lining both an inner and an outer wall of the bucket with a solitary sheath of flexible material by forming the material into a cylindrical shape, draping the sheath on the bucket in depending relation from a lip of the bucket so that a central sheath portion abuts the lip, and contouring upper and lower portions of the sheath against the bucket's inner and outer walls, forming round hole openings in the sheath to accommodate the handle passing therethrough, said hole-type openings being spaced from edges of said outer sheath by portions of said outer sheath, forming a plurality of tool engaging holders on the bucket sheath's upper and lower portions and orienting the holders to be exposed to receive tools thereon, and reinstalling the handle on the bucket through the sheath, whereby tools carried thereon are organized and accessible.

12. The method of claim 11 including lining the wall of the bucket with a plurality of tool holders by superimposing a strip of material on the sheath and seaming vertically extending seams to provide a plurality of loops through which portions of the tools can pass.

13. The method of claim 12 including seaming some of the loops along a bottom edge thereof to provide blind bores, defining pockets.

14. The method of claim 13 including superimposing tool engaging holders upon each other thereby allowing tools to be stacked one on top of the other.

15. The method of claim 14 including providing loops and pockets on both and exterior and interior wall of the bucket.

* * * * *